US005839131A

United States Patent [19]

Schaffer

[11] Patent Number: 5,839,131

[45] Date of Patent: Nov. 24, 1998

[54] BATHTUB WITH CHAIR LIFT

[76] Inventor: Richard C. Schaffer, 3920 W. Vickery, Ft.Worth, Tex. 76107-5626

[21] Appl. No.: 30,454

[22] Filed: Feb. 25, 1998

[51] Int. Cl.[6] ..... A47K 3/12

[52] U.S. Cl. ..... 4/560.1; 4/563.1

[58] Field of Search ..... 4/560.1, 561.1, 4/562.1, 563.1, 564.1, 565.1, 566.1

[56] References Cited

U.S. PATENT DOCUMENTS 5,129,112 7/1992 Schaffer ..... 4/560.1

*Primary Examiner*—Robert M. Fetsuga

[57] ABSTRACT

A fluid operated chair lift is provided for use in a bathtub for allowing a person to enter and leave a bathtub. In the preferred embodiment the apparatus uses water from the water lines of the house or building which is injected into the apparatus for lifting a chair support member thereof and hence the chair and which is released from the apparatus to lower the chair support member and the chair. The apparatus may be coupled in the cavity of the bathtub at different angles and the chair may be coupled to the support member at different angles. In addition, the chair may be rotated relative to the support member to allow a person to be readily seated and unseated onto and from the chair.

17 Claims, 4 Drawing Sheets

Fig. 4
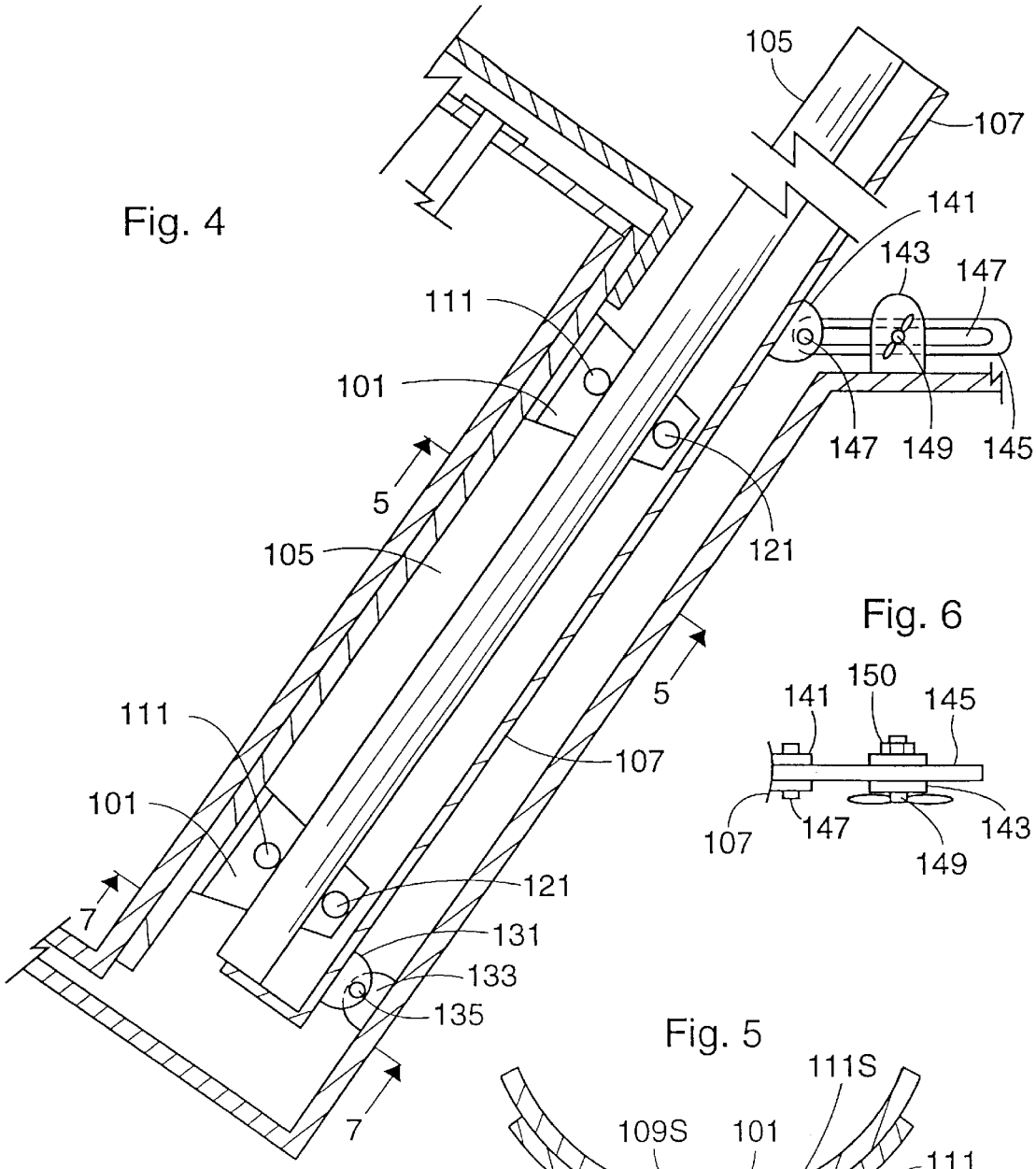
Fig. 6
Fig. 5
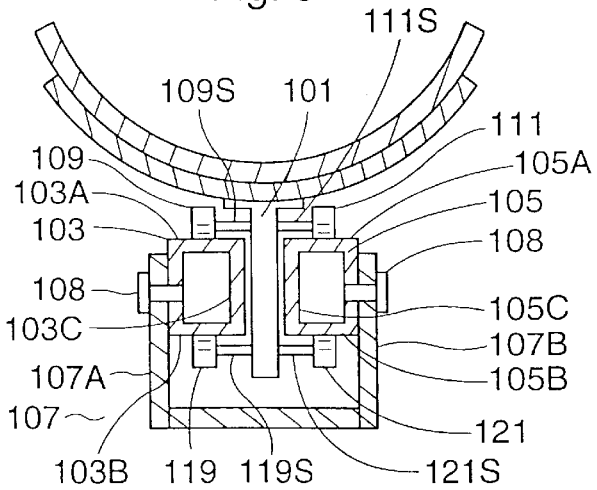

BATHTUB WITH CHAIR LIFT

BACKGROUND OF THE INVENTION

1. Field of the Invention

The invention relates to an apparatus for allowing a person to easily enter and leave a bath tub.

2. Description of the Prior Art

U.S. Pat. No. 5,129,112 discloses a bathtub with a mechanical operated chair lift for allowing a person to enter and leave a bath tub.

SUMMARY OF THE INVENTION

It is an object of the invention for providing a fluid operated chair lift for use in a bathtub for allowing a person to enter and leave a bathtub. In the preferred embodiment the apparatus uses water from the water lines of the house or building which is injected into the apparatus for lifting a chair support member thereof and hence the chair and which is released from the apparatus to lower the chair support member and the chair.

The apparatus may be coupled in the cavity of the bathtub at different angles and the chair may be coupled to the support member at different angles. In addition, the chair may be rotated relative to the support member to allow a person to be readily seated and unseated onto and from the chair.

BRIEF DESCRIPTION OF THE DRAWINGS

FIG. 4 is a cross-section of a portion of the apparatus illustrating more details thereof.

FIG. 5 is a cross-section of FIG. 4 as seen along lines 5—5 thereof.

FIG. 6 illustrates one of the adjustable components of the apparatus of the invention.

DESCRIPTION OF THE PREFERRED EMBODIMENTS

Figure 1:
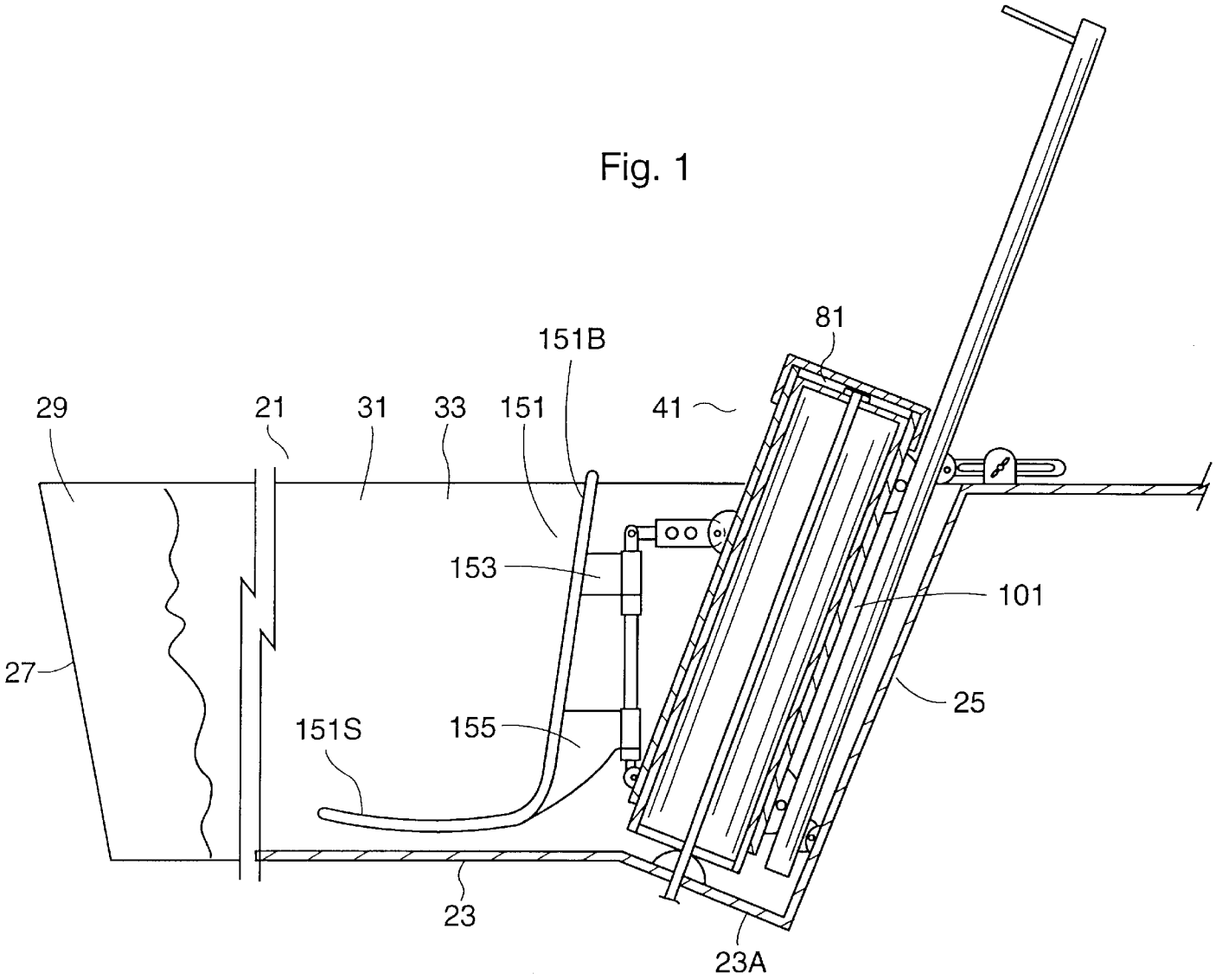
FIG. 1 is a side view of the apparatus of the invention in a bath tub with its chair support member and chair in a lowered position.

Referring to the drawings, there is illustrated a bathtub 21 having a bottom 23, two opposite ends 25 and 27 and two sides 29 and 31 forming a cavity 33 for holding water. The end 25 is slanted and the bottom 23 slants downward at 23A next to end 25.

Figure 2:
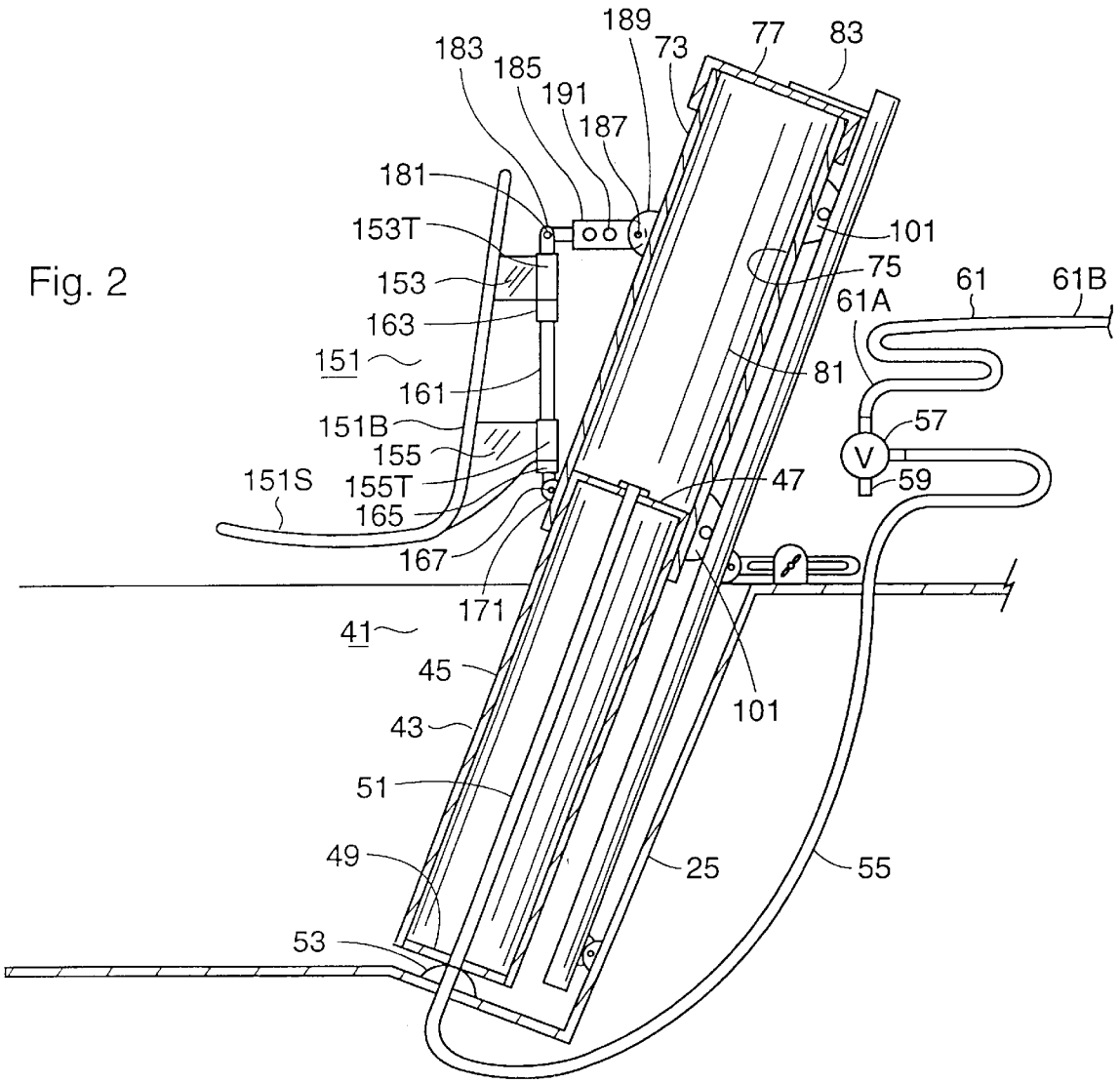
FIG. 2 is a side view of the apparatus of FIG. 1 with its chair support member and chair in a raised position.

Located in the cavity 33 is an apparatus 41 comprising an inner cylinder 43 and an outer cylinder 73 slidable on the cylinder 43 between lower and upper positions as shown in FIGS. 1 and 2. Coupled to the cylinder 73 is a chair 151 which is raised and lowered by the cylinder 73.

The cylinder 43 comprises a hollow cylindrical side wall 45 having a circular top wall 47 connected to the top end of wall 45 and a circular bottom wall 49 coupled to the bottom end of wall 45. A water pipe 51 extends through and is connected to walls 49 and 47 and at its lower end is coupled to a pipe fitting 53 such that the pipe 51 and the cylinder 43 can swivel or pivot relative to fitting 53. The bottom of the fitting 53 is secured to the bathtub wall 23A. A flexible conduit 55 is coupled to fitting 53 such that the conduit 55 is in fluid communication with the pipe 51. The conduit 55 extends to a valve 57 having an outlet 59 and a flexible conduit 61 having one end 61A coupled to an inlet of the valve 57 and an opposite end 61B coupled to a water source in the house or building. The water source may be under pressure in addition to the normal water pressure in water pipes in a conventional house or building.

The cylinder 73 comprises a hollow cylindrical side wall 75 having a circular top wall 77 coupled to the top end of wall 75. The lower end of wall 75 is open with the cylindrical wall 45 fitted into the wall 75 such that the cylinder 73 can slide between its upper and lower positions along cylindrical wall 45.

Assuming that the cylinder 73 is in its lower position as shown in FIG. 1 and the valve 57 is actuated to connect conduit 61 with conduit 55, water is injected through pipe 51 into the chamber 81 of the cylinder 73 and raises the cylinder 73 until its top wall 77 engages a stop 83. The cylinder 73 can be lowered by actuating the valve 57 to close off conduit 61 and connect conduit 55 to the outlet 59 to allow the water in chamber 81 to flow through pipe 51 and conduit 55 through the outlet 59 and into the bathtub 21 when the outlet 59 is located over the bathtub.

Figure 7:
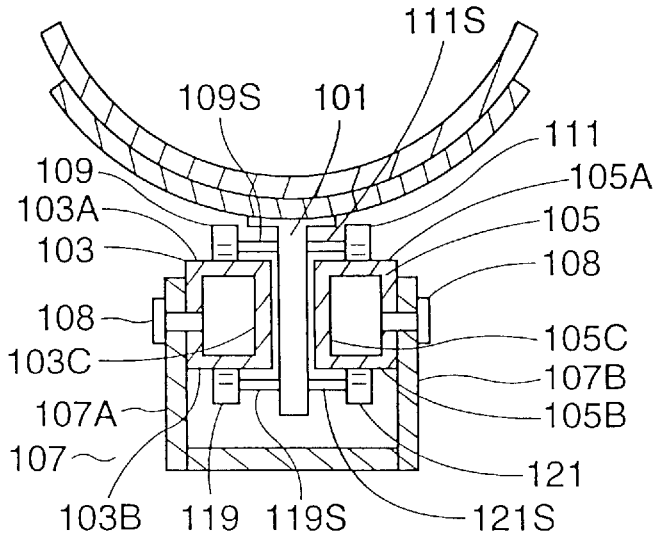
FIG. 7 is a cross-section of FIG. 4 as seen along the lines 7—7 thereof. The lower tabs coupled to the bathtub wall and to the trough are not shown in FIG. 7.

An apparatus is provided for supporting the cylinder 73 and which also aids in supporting the cylinder 43. The apparatus comprises a vane 101 connected to the cylindrical wall 75 at each end. Two square tubes 103 and 105 which act as guides are secured to the sides 107A and 107B of a trough 107, by bolts 108, on opposite sides of the vanes 101. Rollers 109 and 111 coupled to opposite sides of each of the vanes 101 by shafts 109S and 111S are provided to roll on the sides 103A and 105A of tubes 103 and 105. Rollers 119 and 121 coupled to opposite sides of the vanes 101 by shafts 119S and 121S are provided to roll against the sides 103B and 105B of tubes 103 and 105. The two vanes 101 are substantially the same and each includes the rollers 109, 111 and 119, 121 as shown in FIGS. 5 and 7. The sides 103C and 105C of the tubes 103 and 105 are located close to the vanes 101.

The tubes 103 and 105 and trough 107 extend upward for guiding and supporting the cylinder 73 as it moves between its lower and upper positions. The stop 83 is secured to the upper ends of members 103, 105, 107.

Tabs 131 and 133 are connected to trough 107 and the wall 25 of the bathtub and are pivotally coupled together by a pin 135 such that the support members 107, 103, 105, cylinders 73 and 43 can be pivoted to different angular positions relative to the bathtub and held in a desired position by tabs 141, 143, and member 145. Tabs 141 and 143 are connected to the trough 107 and bathtub 21 respectively. Member 145 is pivotally coupled to the tabs 141 by a pin 147. Member 145 has a slot 147 in which is located the shaft of a bolt 149 which also extends through an aperture (not shown) formed through tab 143. A nut 150 is screwed to the bolt 149 to secure the trough 107 to the bathtub in the desired angular position.

Figure 3:
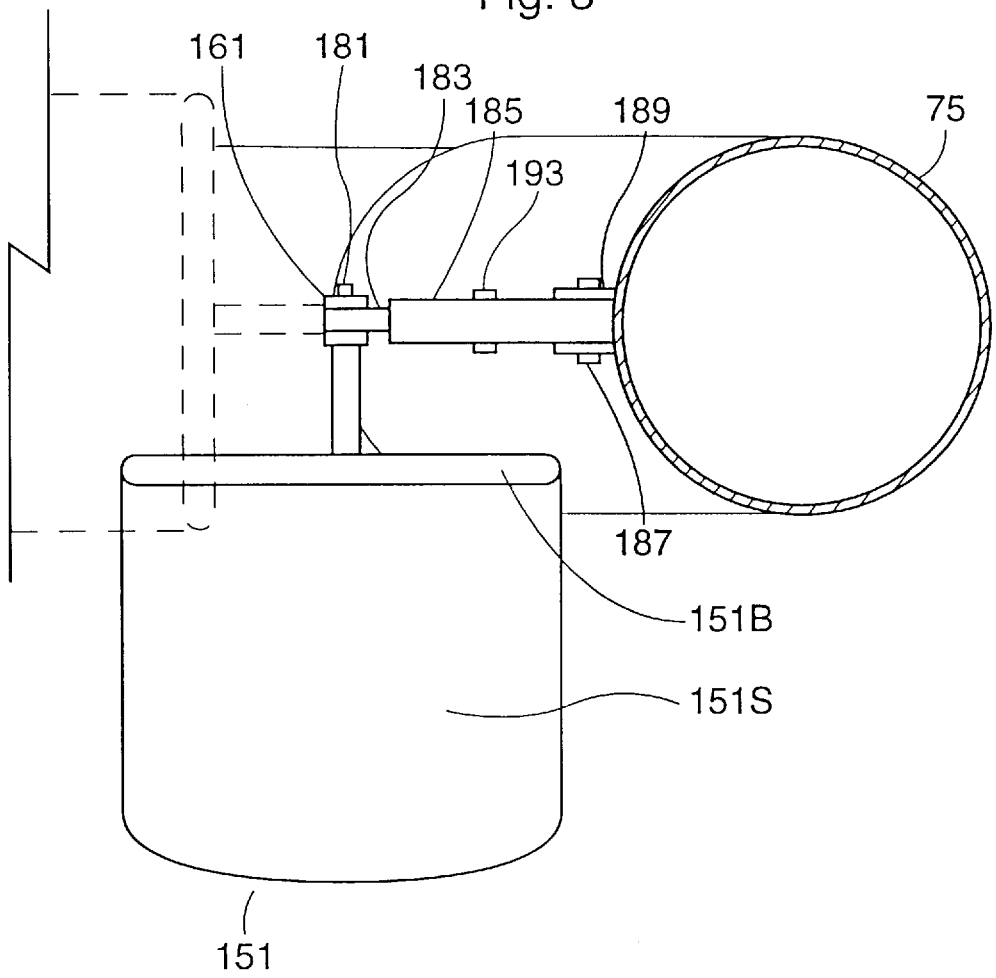
FIG. 3 is a view of FIG. 2 looking down on the chair thereof with the chair rotated 90 degrees from its position shown in FIG. 2. The dotted lines in FIG. 3 show the chair in the position shown in FIG. 2.

The chair 151 comprises a seat 151S and a back 151B. Brackets 153 and 155 are coupled to the rear of the back 151B and have tubular members 153T and 155T with a rod extending therethrough such that the brackets 153 and 155 and hence the chair 151 can pivot about the rod 161 between a position as shown in FIGS. 1 and 2 to a position shown in FIG. 3. Members 163 and 165 are supports fixedly secured to the rod 161 to support the brackets 153 and 155 on the rod 161.

The lower end of the rod 161 is pivotally coupled by a pin 167 to a tab 171 which is connected to the cylindrical wall 75. The upper end of the rod 161 is pivotally coupled by a pin 181 to a rod 183. Rod 183 is slidably located in tubular member 185 which is pivotally coupled by way of a pin 187 to tabs 189 which is connected to the cylindrical wall 75. The rod 183 has at least one apertures formed therethrough which can be aligned with a plurality of holes 191 (only two of which are shown) for receiving a pin 193 (See FIG. 3) for adjusting the angle of the rod 161 and hence the chair 151 relative to the cylinder 73.

The conduits 55 and 61 are long enough for the user to control the valve 57 while sitting in the chair 151 with the valve 57 located over the bathtub.

In using the apparatus, to allow one to enter the bathtub, the chair 151 is raised to the level as shown in FIG. 2 by operating the valve 57 to couple conduit 61 to conduit 55 to inject water into the chamber 81 by way of pipe 61. The valve 51 then is moved to a closed position. The user turns the seat 151 to a position shown in FIG. 3, transverse to the position shown in FIG. 2; sets in the chair; turns the chair in the position shown in FIG. 2; and then operates the valve 57 to close off conduit 61 and connect conduit 55 with outlet 59 while holding the valve 57 over the bathtub to discharge the water in chamber 81 into the bathtub to allow the cylinder 73 and hence chair 151 to be lowered to the position shown in FIG. 2.

After bathing, the user actuates the valve 57 to allow water by way of conduit 61, valve 57, conduit 55, and pipe 51, to be injected into chamber 81 to raise the cylinder 73 and hence the chair 151 to the position as shown in FIG. 2 at which time the valve 57 is actuated to a closed position. The operator then pivots the chair 151 to the position shown in FIG. 2, and leaves the chair. The operator then may operate the valve 157 to connect conduit 55 with the valve outlet 59 to discharge the water in chamber 81 into the bathtub to lower the cylinder 73 and the chair 151.

The apparatus including the cylinders 43 and 73, trough 107, tubes 103 and 109 can be made of suitable plastic or metal.

I claim:

1. A bathtub and a chair lift wherein the bathtub has a cavity for holding water between two spaced apart ends, comprising:

a lift system comprising a first member located in said cavity of said bathtub and a second member coupled to said first member for movement along a path between upward and lower position for movement relative to said first member, a fluid chamber formed between said two members such that fluid may be injected into said fluid chamber to move said second member to said upward position and released from said fluid chamber to allow said second member to move to said lower position, coupling means for coupling said two members to said bathtub at one of said ends of said bathtub, said coupling means allows said second member to move between said lower and upper positions while said first member remains in said cavity of said bathtub, a chair coupled to said second member, control for injecting a fluid into said fluid chamber for causing said second member to move to said upper position to raise said chair and for releasing said fluid from said fluid chamber to allow said second member to move to said lower position to lower said chair.

2. The bathtub and chair lift of claim 1, wherein:

said coupling means couples said first and second members to said bathtub at said one end such that said path forms an acute angle relative to a line extending between said two ends with said upper end of said first member being located further from the other end of said bath tube than said lower end of said first member.

3. The bathtub and chair lift of claim 2, wherein:

said coupling means comprises means for allowing said first and second members to be coupled to said bathtub at different angles relative to said bathtub to locate said chair at different angels relative to said bathtub.

4. The bathtub and chair lift of claim 3, comprising:

chair coupling means for coupling said chair to said second member at different angular positions relative to said second member.

5. The bathtub and chair lift of claim 2, comprising:

chair coupling means for coupling said chair to said second member at different angular positions relative to said second member.

6. The bathtub and chair lift of claim 1, wherein:

said coupling means comprises means for allowing said first and second members to be coupled to said bathtub at different angles relative to said bathtub to locate said chair at different angels relative to said bathtub.

7. The bathtub and chair lift of claim 6, comprising:

chair coupling means for coupling said chair to said second member at different angular positions relative to said second member.

8. The bathtub and chair lift of claim 6, wherein said coupling means, comprises:

vane means coupled to said second member for movement with said second member, two spaced apart support members located on opposite sides of said vane means for guiding said vane means and hence said second member as it moves between said lower and upper positions, said two support members each having first and second opposite facing sides with said first sides facing said side wall of said second member, rollers coupled to said vane means for engaging said first and second opposite facing sides of said support members for supporting said second member as it moves between said lower and upper positions, said two support members having lower and upper ends, means for pivotally coupling structure including said lower ends of said two support members to said bathtub within said bathtub cavity, and adjustable means for coupling said two support members and hence first and second members to said bathtub at different angles.

9. The bathtub and chair lift of claim 8 comprising:

pivot coupling means for pivotally coupling a lower portion of said chair to a lower portion of said second member, and adjustable means coupled to said chair and to said second member above said pivot coupling means to allow said chair to be coupled to said second member at different angular positions relative to said second member.

10. The bathtub and chair lift of claim 8, wherein:

said control means comprises a valve for allowing water to be injected into and released from said fluid chamber for causing said second member to be moved to said upper and lower positions.

11. The bathtub and chair lift of claim 10, wherein:

said first and second members comprise first and second cylinders respectively with said second cylinder being slidable on said first cylinder along said path.

12. The bathtub and chair lift of claim 8, wherein:

said first and second members comprise first and second cylinders respectively with said second cylinder being slidable on said first cylinder along said path.

13. The bathtub and chair lift of claim 1, comprising:

chair coupling means for coupling said chair to said second member at different angular positions relative to said second member.

14. The bathtub and lift of claim 13, wherein said chair coupling means comprises:

pivot coupling means for pivotally coupling a lower portion of said chair to a lower portion of said second member, and adjustable means coupled to said chair and to said second member above said pivot coupling means to allow said chair to be coupled to said second member at different angular positions relative to said second member.

15. The bathtub and chair lift of claim 1, wherein:

said control means comprises a valve for allowing water to be injected into and released from said fluid chamber for causing said second member to be moved to said upper and lower positions.

16. The bathtub and chair lift of claim 1, wherein:

said first and second members comprise first and second cylinders respectively with said second cylinder being slidable on said first cylinder along said path.

17. The bathtub and chair lift of claim 16, wherein:

said control means comprises a valve for allowing water to be injected into and released from said fluid chamber for causing said second member to be moved to said upper and lower positions.

* * * * *